United States Patent [19]

Skendrovic

[11] 4,319,739

[45] Mar. 16, 1982

[54] METALLURGICAL PROCESSING VESSEL

[75] Inventor: Lawrence Skendrovic, West Mifflin, Pa.

[73] Assignee: William M. Bailey Company, Washington, Pa.

[21] Appl. No.: 144,356

[22] Filed: Apr. 28, 1980

Related U.S. Application Data

[62] Division of Ser. No. 914,998, Jun. 13, 1978, Pat. No. 4,239,291.

[51] Int. Cl.[3] ..... C21B 7/04; H05B 7/18

[52] U.S. Cl. ..... 266/280; 13/9 R

[58] Field of Search ..... 266/280–286; 75/10–12; 13/9 R

[56] References Cited

U.S. PATENT DOCUMENTS 4,014,531 3/1977 Takashima ..... 266/280

*Primary Examiner*—P. D. Rosenberg

*Attorney, Agent, or Firm*—Carothers and Carothers

[57] ABSTRACT

An industrial metallurgical delining assembly for dislodging and removing refractory or other material from upwardly open metallurgical process vessels. The assembly includes a spider-leg frame, the feet of which are supported on the upper periphery of the vessel, and supports a turntable over the top of the vessel. An extensible and articulatory boom depends from the turntable and selectively carries working tools at its free end for dislodging and removing material from the vessel. The vertical spacing between the uppermost end of the vessel and the turntable is sufficient to provide clearance for the boom to remove such dislodged material to a location outwardly from the vessel.

5 Claims, 6 Drawing Figures

METALLURGICAL PROCESSING VESSEL

CROSS REFERENCE TO RELATED APPLICATION

This is a divisional of patent application Ser. No. 914,998 filed June 13, 1978, U.S. Pat. No. 4,239,291 for Industrial Metallurgical Delining Assembly.

A delining assembly and more particularly an improved delining assembly for use in industrial metallurgical applications.

In large industrial metallurgical processes which utilize equipment such as electric and blast furnaces, soaking pits and ladles, it is necessary to periodically replace refractory linings. With electric furnaces which are capable of a heat every two and one-quarter hours, it has been found necessary to replace the side walls of such furnaces every two to two and one-half weeks, or approximately 150 heats, and to replace the bottom refractory every one and one-half to two years.

Before a new refractory lining can be installed, the existing refractory must be removed from the furnace wall and such removal has commonly been accomplished by disintegrating and dislodging the material with a percussive tool. One common approach to such removal of old refractory is to do so manually with a crew of personnel equipped with jack hammers and the like. Another common approach has been through the utilization of clean-out machines which were movably supported adjacent the upper end of the furnace or soaking pits; for example, as illustrated in U.S. Pat. No. 3,370,654 and No. 3,370,888.

Manual removal of refractory requires significant down time to permit a furnace or a bank of soaking pits to cool down a sufficient amount to allow personnel to approach the area to be replaced. For example, an electric furnace must cool down at least 24 hours before a crew of men may begin the refractory removal, which may take 12 to 16 hours. Inasmuch as down-time costs of an electric furnace may be approximately $6,000.00 per hour, any delay in replacing refractory is extremely costly. Furthermore, even when cooled down for approach, the personnel working on refractory replacement often are required to wear bulky protective clothing. In addition to the high heat, dusty atmosphere and heavy tool handling, the bulky clothing inhibits mobility and thus further contributes to an extremely hazardous working environment for involved personnel. Still further, once the old refractory has been dislodged, manual means for removing the refractory from the furnace or soaking pits, for example, by bucket and overhead line, has been found to be inefficient and further exposes the worker to still more hazards.

The clean-out machines of the type illustrated in the above-mentioned Patents, have overcome some of the problems mentioned herein with respect to manual removal of refractory, however, such prior clean-out machines are deficient in a number of areas. For example, such prior machines were generally designed as a fabricated unit and are not readily adaptable to differing diameter applications. Furthermore, the impactor, supporting boom and supporting structure therefor have somewhat limited articulation and cannot efficiently reach all areas for refractory removal. Still further, such prior clean-out machines have been designed primarily to support impactors, and no significantly improved means have been designed therein for the efficient removal of dislodged refractory from the furnace or soaking pits.

By means of the present invention, which includes a delining assembly having the primary operational components thereof of modular construction, and which includes a supporting frame which movably and rigidly supports the uppermost end of a downwardly extending support boom upwardly of the furnace or soaking pit, the above-mentioned problems are overcome, or at least greatly alleviated. Further, the invention herein includes means for selectively mounting a variety of impactor tools as well as a bucket attachment. The vertical spacing between the furnace or soaking pit and the upper boom mounting, coupled with the boom and impactor articulation provided by this invention, provides an assembly which not only is capable of efficiently dislodging the refractory walls and bottom, but in addition, has a capability for efficiently removing the dislodged refractory from the furnace or soaking pit.

Accordingly, it is a primary object of the present invention to provide a delining assembly for efficiently dislodging refractory and, thereafter, removing such dislodged refractory.

A further object of the present invention is to provide a delining assembly having main operational components thereof of a modular construction and arrangement.

Still another object of the present invention is to provide a delining assembly wherein the boom and impactor have an improved degree of articulation.

Still another object of the present invention is to provide a simplified support and valving arrangement for the rotational support of the impactor boom.

An additional object of the present invention is to provide a furnace arrangement having an improved means for removing dislodged bottom refractory therefrom.

Other objects and advantages appear in the following description and claims.

The accompanying drawings show, for the purpose of exemplification without limiting the invention or the claims thereto, certain practical embodiments illustrating the principles of this invention wherein:

Figure 5A:
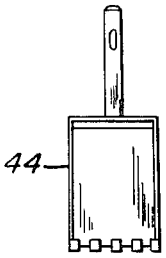
Figure 5B:
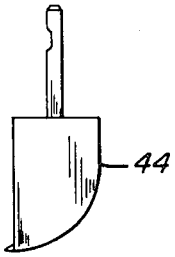

FIGS. 5*a* and 5*b* are respectively, front and side elevational views of other equipment which may be selectively used with the present invention.

Figure 6A:
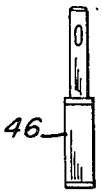
Figure 6B:
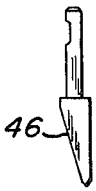

FIGS. 6*a* and 6*b* are respectively, front and side elevational views of still other equipment which may be selectively used with the present invention.

Figure 1:
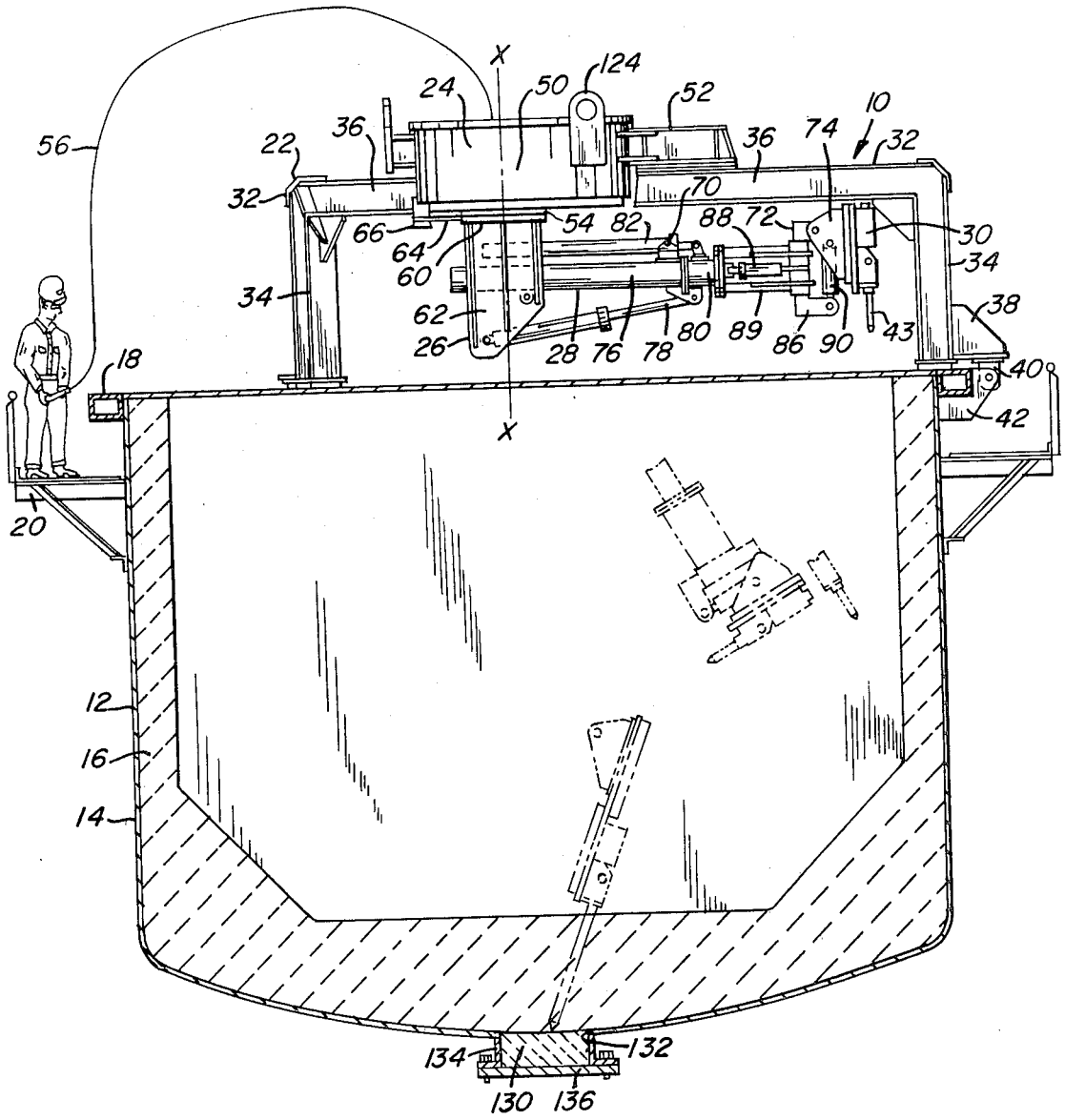
FIG. 1 is a schematic side elevational view, partly in section, of a delining assembly of the present invention mounted on an electric furnace.
Figure 2:
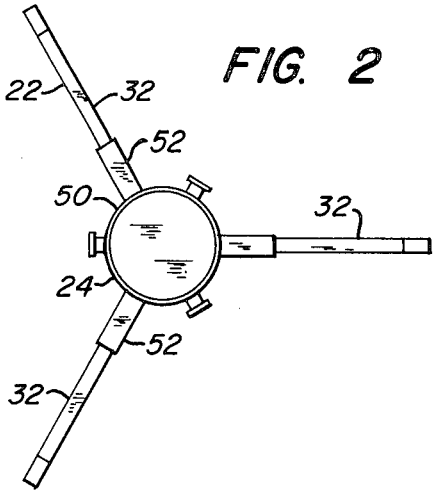
FIG. 2 is a reduced schematic plan view of the delining assembly illustrated in FIG. 1.
Figure 4:
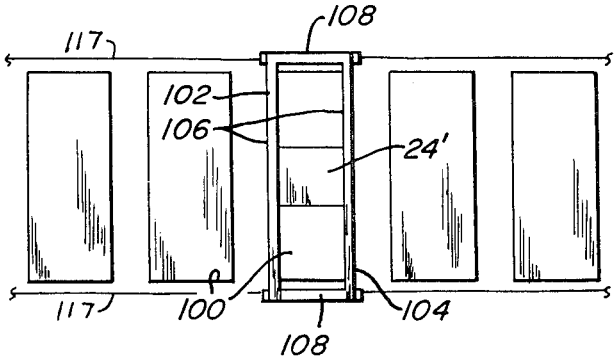
FIG. 4 is a reduced schematic plan view of the delining assembly illustrated in FIG. 3.

Referring to FIGS. 1 and 2, there is illustrated an industrial metallurgical delining assembly of the present invention, which is generally indicated at 10, and is shown as being in operational position on top of an electric furnace 12. Furnace 12 may be of any suitable construction and is schematically represented as comprising: an upwardly open generally bowl-shaped metallic shell 14, refractory 16 suitably fabricated to the entire interior periphery of shell 14, a generally tubular flange 18 carried by shell 14 and extending around the outer periphery thereof adjacent the upper end, and a peripherally-extending catwalk 20 carried by shell 14 adjacent an upper end portion thereof.

Delining assembly 10 comprises: an upwardly extending frame portion 22, a modular power and turntable portion 24 carried by frame portion 22, a boom support portion 26 extending downwardly from turntable portion 22 and carried thereby for rotation with respect to fixed portions thereof about vertical axis X—X, a boom portion 28 pivotally carried by boom support portion 26 adjacent a lower end portion thereof, and an impactor portion 30 pivotally carried by boom portion 28 adjacent to the free end thereof.

The frame portion 22 comprises a plurality, as shown three, legs 32. Each leg 32 includes a vertically extending column 34 and a generally horizontally extending boom 36 having the outer end thereof suitably rigidly secured to column 34 adjacent the upper end thereof and extends inwardly therefrom. In operational position, the lower ends of columns 34 are seated on the flange 18 of furnace 12 and suitably releasably secured thereto. Such an arrangement of releasably securing is illustrated in FIG. 1 wherein columns 34 each include an outwardly extending gusset plate 38 adjacent the lower end thereof. A connecting plate 40 extends downwardly from gusset plate 38, and the lower end portion thereof abuts between an outer pair of adjacent outwardly extending gusset plates 42 which are carried by the furnace 12. After abutting alignment of connecting plate 40 with adjacent gusset plates 42, a pin, bolt, or the like is inserted through the aligned plates for each leg to maintain the columns 34 in the operational position. It is to be noted that a securing arrangement as described hereinabove offers an efficient and economical manner for releasably securing assembly 10 to furnace 12 with only a minimum of retrofit or redesign required for the furnace 12 (i.e., the gusset plates 42). Minimum adjustment is required to lower the assembly onto the furnace, and prior art uses of nuts, bolts, weights, etc. are eliminated to hold the assembly in place as the assembly is dropped into position and the pins are quickly slid into place. It is to be further noted that the three-leg or tripod configuration of frame portion 22 as described above offers a supporting arrangement for the portions of assembly 10 suspended therefrom which is capable of directing loading imparted thereto to the furnace 12, while simultaneously offering minimal transverse obstruction of the vertical spacing between furnace 12 and beams 36. As will be more fully described hereinafter, after refractory 16 is dislodged from shell 14, the assembly 10 provides means for removing the dislodged refractory 16 from the furnace 12 through the use of a bucket 44, which is selectively carried by boom portion 28 (see FIG. 3). The dislodged refractory 16 is power loaded into the bucket 44 and thereafter the boom portion 28 is maneuvered to raise the loaded bucket 44 upwardly and outwardly from the furnace 12 and rotated to dump the debris for subsequent disposal. Thus, it can readily be seen that the minimum obstruction of the space intermediate the top of furnace 12 and beams 36 is important for the efficient maneuverability of bucket 44 outwardly of furnace 12.

Turntable portion 24 is of a self-contained modular construction which includes the electrical and hydraulic power pack and turntable driving assembly surrounded by a cylindrical outer body member 50 which is releasably carried by frame portion 22 adjacent the inner end of the circumferentially spaced beams 36. A plurality, as shown three, peripherally-spaced connecting members 52 are secured to the body member 50 and extend outwardly therefrom. The angular spacing of connecting members 52 exactly match the desired angular spacing of leg portions 32. Both connecting members 52 and beams 36 have a generally H-shaped cross-sectional configuration with the webs thereof extending vertically. In assembled position, the lower flanges of members 52 are seated on the upper flanges of adjacent beams 36 and the seated relationship is thereafter releasably maintained by a plurality of bolts being inserted through adjacent flanges.

The above-described arrangement of releasably securing turntable portion 24 to frame portion 22 substantially increases the versatility of the delining assembly 10 of the present invention. Electric furnaces are sized in a large range of differing diameters. Thus, for example, if the delining assembly 10 were being used on a 14 ft. diameter furnace 12 and it was thereafter desired to use such assembly 10 on a 24 ft. diameter furnace 12, it would merely be necessary to release the bolts extending between the adjacent flanges of members 52 and beams 36 and thereafter position turntable 24 on another frame portion 22 which has beams 36 of a longer length to compensate for the larger diameter furnace 12. Substitute means for automatically extending beams 36 may also be employed.

Turntable portion 24 additionally includes a rotatable plate 54 carried thereby adjacent the lower end of body member 50. Plate 54 is rendered rotatable about axis X—X in any suitable manner, for example, by appropriate hydraulic valving, motors, gearing and the like carried by portion 24 within the interior of body member 50. Such valving, motors, gearing and the like are not shown, and a description thereof is not necessary for the understanding of this invention. The rotation of plate 54 as well as the reciprocating movement of piston assemblies for the articulation of boom portion 28 and impactor portion 30 are controlled in any suitable manner, for example, by remote pendant 56 used by an operator position on catwalk 20 on an equivalent platform.

Boom support portion 26 includes an upper connecting plate 60 which extends in a generally horizontal plane and is suitably releasably secured to turntable plate 54 such as by bolts or the like. A pair (only one is shown) of transversely spaced side plates 62 have the upper end thereof secured to connecting plates 60 and extend downwardly therefrom. A rear end portion of boom portion 28 is received transversely intermediate the spaced plates 62 and is pivotally supported therebetween. The boom support portion 26 additionally includes a turntable stop arm 64 extending outwardly therefrom adjacent the upper end thereof. Stop arm 64 is cooperable with a downwardly extending turntable limited movement mechanical floating stop 66 supported from body member 50 adjacent the lower end thereof. With such an arrangement of arm 64 and stop 66, the turntable plate 54 and support portion 26 supported therefrom are prevented from rotating more than 365 degrees in either direction. This limitation is accomplished by arm 64 engaging stop 66 which in turn results in stopping of the rotation of turntable plate 54.

Stop 66 is a mechanical free swinging stop which floats for 5 degrees in either direction, thereby permitting the turntable to pivot left or right for more than 360 degrees, thereby preventing blind or dead spots. The stop is weighted to return to a neutral position. The turntable travel can thus overlap by 5 degrees, giving a rotation of 365 degrees left or right.

While limit switches which operate the valving in the drive assembly for the turntable may be substituted for mechanical floating stop 66, such a mechanical stop is preferred, as it is more foolproof and failsafe.

This limitation on rotation of 365 degrees in either direction gives a variety of benefits, for example, a simpler arrangement of hydraulic hose; no expensive multi-stage rotary fluid fitting is required; and there is no requirement for an independent turntable brake.

Boom portion 28 comprises: an elongated main boom assembly 80; a dump and swing assembly 72 carried by boom assembly 80; and a work mounting assembly 74, pivotally carried by swing assembly 72 adjacent the free end thereof. The main boom assembly 80 includes a rear portion 76 which is carried by support portion 26 and is pivotal with respect thereto about a horizontal axis by means of a suitable reciprocating piston assembly 78 extending between portions 26 and 76 and suitably pivotally secured thereto. A forward portion 80 of boom assembly 70 is rendered axially reciprocal with respect to rear portion 76 by means of a piston assembly 82 which is reciprocal along an axis generally parallel to the longitudinal axis of assembly 70. As illustrated in FIG. 1, swing and dump assembly 72 includes a rear portion 89 and a forward or yoke portion 86 which is rendered pivotal with respect to rear portion 89 about an axis transverse to the axis of boom portion or assembly 28, by means of longitudinally extending piston assemblies 88 which extend therebetween adjacent each side thereof (only one assembly 88 is shown). If preferred, assemblies 88 and rear portion 89 may be replaced with a suitable roll-over assembly generally indicated at 84' in FIG. 3, which is operable in a known manner such that assembly 74 will be coaxially rotatable about the longitudinal axis of boom portion 28. This action not only permits positioning of the work tool in a plane transverse to the longitudinal axis of boom portion 28, but when using a bucket 44, it can be rolled over and dumped. The work mounting assembly 74 is carried by forward portion 86 and is also rendered pivotal with respect thereto about a horizontal axis by means of a suitable piston assembly 90 extending therebetween.

Figure 3:
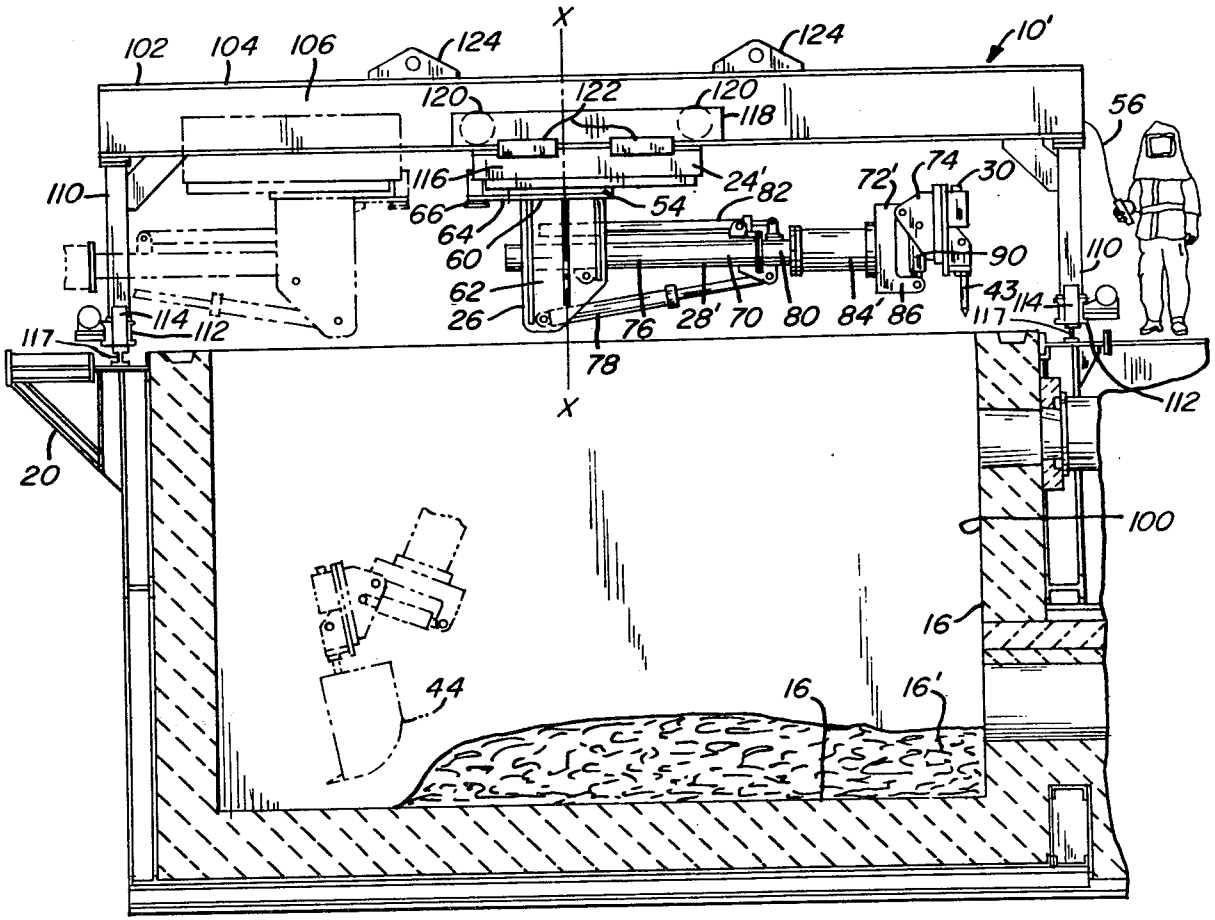
FIG. 3 is a schematic side elevational view, partly in section, of another embodiment of a delining assembly of the present invention, as mounted on rails on top of a soaking pit.

As is now evident from the above description and reference to the solid and phantom positions of the boom portions 28 and 28', as are respectively illustrated in FIGS. 1 and 3, the degree of articulation of the various components of the boom portion, coupled with the rotational mounting thereof about axis X—X, provides an arrangement wherein all of the refractory 16 within a furnace 12 may be broken and dislodged and thereafter such refractory 16 may be removed from the furnace 12 by the bucket 44, as shown in FIG. 1, or wherein all of the slag or refractory in the soaking pit may be broken and removed as illustrated in FIG. 3. The impactor portion 30 is carried by assembly 74 adjacent the forward or free end thereof and is structured to selectively carry a variety of tools therefrom for breaking the refractory 16 or removing the broken refractory 16 from the furnace 12. Such selectively interchangeable tools may include a standard moil point 44 for preliminary disintegrating or breaking strokes, a ripper 46 (see FIGS. 6*a* and 6*b*) for finish of intermediate vertical impact strokes, or a bucket 44 (see FIGS. 3, 5*a* and 5*b*) for removal of broken refractory 16 from the furnace 12. A variety of other tools, for example, a scraper (not shown) having a wedge-shaped free end, may additionally be selectively utilized with the delining assembly 10 of the present invention.

FIG. 3 illustrates another form of a delining assembly, generally indicated at 10', of the present invention. Many components of the embodiment illustrated in delining assembly 10' are identical or quite similar to those components described herein with respect to delining assembly 10. Accordingly, for purposes of description, identical components to assembly 10 shall be identified with identical numerals, and similar components shall be identified with identical numerals primed.

Delining assembly 10' is adapted for use with a battery of soaking pits 100. Assembly 10' comprises an upwardly extending mobile frame portion 102; a modular power and turntable portion 24' carried by frame portion 102; and portions 26, 28' and 30, which are essentially identical to corresponding portions described hereinbefore with respect to delining assembly 10.

Mobile frame portion 102 is of a generally gantry-like configuration, which comprises: an upper horizontal extending frame section 104 having a rectangular configuration composed of long and short side beams 106 and 108, respectively; columns 110 extending vertically downwardly from section 104 adjacent the corners thereof; and transversely spaced wheel carrying members 112 extending parallel to short beams 108 and having the axial ends thereof secured to respective columns 110 adjacent the lower ends thereof. Suitable rail wheels 114 are carried by members 112 adjacent each axial end thereof. Wheels 114 are positioned to roll along a transversely spaced pair of continuously extending rails 11 which are positioned adjacent the upper end of the bank of soaking pits 100. Turntable portion 24' is of a modular construction which includes a generally rectangular outer body member 116 having dual rail support means 118 extending outwardly from transversely spaced sides thereof and which include longitudinally spaced wheels 120 thereon. Support means 118 are cooperable with the upper surface of adjacent lower flanges of respective long side beams 106 in a manner that beams 106 support portion 24' for longitudinal movement therealong by rolling contact between wheels 120 and such flanges. Wheels 120 are powered in any suitable manner. When portion 24' is positioned at a desired location, suitable means, such as hydraulically operated clamps 122, are energized to apply a compressive retaining force to the lower flanges of the long side beams 106.

With such an arrangement as described hereinabove, delining assembly 10' is readily sequentially locatable over various soaking pits 100 in a bank of soaking pits. Further, turntable portion 24' may be easily moved along the long side beams 106 to preferred locations for breaking up slag build-up 16' and removing it in a manner similar to that described with regard to refractory removal in FIG. 1. When required, it can also be utilized for breaking out refractory 16 and thereafter removing such refractory 16 from the soaking pits 100. Still further, it is to be noted that the columns 110 are of a height to provide adequate vertical clearance between the upper end of soaking pits 100 and the upper frame section 104 thereby facilitating the removal of the refractory 16. Further, the turntable portion 24' is of a modular construction and is readily removable from frame portion 102 to facilitate the use thereof with a differing dimensional frame portion 102.

Still another feature to be noted with respect to the invention herein is the use of upwardly extending lifting lugs 124 with both delining assemblies 10 and 10'. With delining assembly 10', the lifting lugs 124 extend upwardly from the upper flanges of long side beams 106. In either case, the lifting lugs provide a convenient means for lifting such delining assemblies with an overhead crane or the like for positioning, repositioning or assembly.

Still another feature of the present invention with respect to an electric arc furnace 12 of FIG. 1 is the inclusion of a knock-out assembly 130 in the bottom portion thereof. Assembly 130 is provided as a further aid to the removal of refractory 16 from a furnace 12 when the bottom refractory 16 is to be broken up and comprises: an opening 132 through a central bottom portion of shell 14; downwardly extending form retaining cylinder 134 secured to shell 14 adjacent to the periphery of opening 132; and a circular blind plate or cover 136 releasably secured with bolts or the like at its periphery to the lower annular flange of form cylinder 134. Suitable refractory or heat resistant grout is positioned in the space between opening 132 and cover 136 to provide a suitable backing for interior refractory 16. When the bottom refractory 16 is to be broken up, the cover 136 is released and removed. Thereafter the moil point 43 is used to break out the refractory 16 as well as the refractory or grout which was provided intermediate opening 132 in cover 136. Thus, if desired, the broken refractory 16 may now be removed from the electric furnace 12 through the opening 132 and thereafter may be removed from the work area by suitable conveying means. This arrangement alleviates the time delay and equipment necessary to lift the broken refractory 16 upwardly and out of the furnace 12.

The embodiments described herein are the presently preferred embodiments of a delining assembly constructed in accordance with the present invention. However, it is understood that various modifications may be made to the embodiments described herein by those knowledgeable in the art without departing from the scope of the invention as defined by the claims set forth hereinafter. For example, the invention is equally applicable to delining assemblies for use in metallurgical processes other than those described herein; other means of articulation for boom portion 28 or 28' may be utilized; the configuration of frame portions 22 or 102 may be altered; and the like.

I claim:

1. In a metallurgical process vessel having an upwardly open metallic outer shell with refractory disposed on all inner peripheral surfaces of said shell, the improvement comprising: refractory clean-out means positioned in the bottom of said vessel; and said clean-out means including an opening formed through said shell at the bottom location and frangible heat resistant material covering said opening and extending downwardly therefrom.

2. A process vessel as claimed in claim 1 additionally including a cover plate carried by said shell at a location and in a manner that said plate is downwardly spaced from said shell and underlies the entire periphery of said opening.

3. A process vessel as claimed in claim 2 wherein said frangible material is disposed intermediate said opening and said plate.

4. A process vessel as claimed in claim 3 wherein said plate is releasably carried by said shell.

5. A process vessel as claimed in claim 4 wherein said vessel is an electric furnace.

* * * * *